US008202120B2

(12) United States Patent
Ko

(10) Patent No.: US 8,202,120 B2
(45) Date of Patent: Jun. 19, 2012

(54) HIGH FREQUENCY SOCKET CONNECTOR

(75) Inventor: Wen-Chih Ko, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/804,796

(22) Filed: Jul. 28, 2010

(65) Prior Publication Data

US 2011/0269324 A1 Nov. 3, 2011

(30) Foreign Application Priority Data

Apr. 29, 2010 (TW) ..... 99207840 U

(51) Int. Cl.
*H01R 13/648* (2006.01)

(52) U.S. Cl. ..... 439/607.35; 439/660

(58) Field of Classification Search .....
439/607.35–607.38, 607.54–607.55, 660
See application file for complete search history.

(56) References Cited

U.S. PATENT DOCUMENTS

| | | | | |
|---|---|---|---|---|
| 7,686,656 | B2 * | 3/2010 | Zheng et al. | 439/660 |
| 7,753,724 | B2 * | 7/2010 | Gong et al. | 439/541.5 |
| 7,789,706 | B2 * | 9/2010 | Chen et al. | 439/607.35 |
| 7,841,905 | B2 * | 11/2010 | Zheng et al. | 439/660 |
| 7,862,346 | B1 * | 1/2011 | Wan et al. | 439/79 |
| 7,862,378 | B1 * | 1/2011 | Wan et al. | 439/607.35 |
| 7,874,868 | B2 * | 1/2011 | Chang | 439/540.1 |
| 7,922,533 | B2 * | 4/2011 | Wang et al. | 439/607.23 |

* cited by examiner

*Primary Examiner* — Hien Vu
(74) *Attorney, Agent, or Firm* — Charles E. Baxley

(57) ABSTRACT

A high frequency socket connector has an insulating housing, a mounting bracket, multiple first terminals, multiple second terminals and a shell. The first and second terminals are mounted in the insulating housing, are capable of implementing USB 3.0 protocol. The shell covers the insulating housing and terminals. Each of the terminals has a SMT soldering section adapted to SMT soldering processes. All the SMT soldering sections are arranged in a transverse row to make the socket connector compact.

10 Claims, 10 Drawing Sheets

HIGH FREQUENCY SOCKET CONNECTOR

BACKGROUND OF THE INVENTION

1. Field of the Invention

The present invention relates to a connector, and more particularly to a surface mount technology (SMT) type high frequency socket connector that has SMT type terminals soldered on a PCB through SMT soldering processes to reduce total size of the socket connector and raise the utilization rate of the PCB.

2. Description of Related Art

Conventional Universal Serial Bus (USB) 2.0 connectors are used popularly in various electronic devices. Most of computer peripherals are equipped with USB connectors. Because electronic devices are constantly developed to increase transmission speed thereof, the USB 2.0 protocol does not meet the current transmission speed requirement of new electronic devices. Therefore, the USB Implementers Forum sets forth new USB 3.0 protocol for higher data transmission speed.

The USB 3.0 protocol is compatible with the USB 2.0 protocol and provides theoretical 5 Gbps of data transmission speed.

Furthermore, different electronic devices such desktops and laptops are connected to each other by cables for data transmission. A conventional cable has two ends, a plug connector and a receptacle connector. The plug and receptacle connectors are mounted respectively in the ends and may be connected to different electronic devices.

However, a USB 3.0 socket connector has two rows of terminals for implementing USB 2.0 or 3.0 protocol alternatively so that the USB 3.0 socket connector has a large size and complicated structures to increase the molding design cost and manufacturing cost. Furthermore, the USB 3.0 socket connector easily fails the high frequency data transmission due to crosstalk between high frequency signal transmission terminals. Moreover, the two rows of the soldering sections occupy more surface areas of a PCB when mounted on the PCB so decreasing the utilization rate of the PCB.

Furthermore, conventional socket connectors are mounted on the PCB through the surface mount technology (SMT) process. The SMT process reduces the size of the socket connector when compared to the through hole technology (THE) process.

However, conventional USB 3.0 socket connectors fail to simultaneously employ the SMT configurations and single row arrangement to the terminals thereof so aforementioned incompact volume and crosstalk problems still remain.

To overcome the shortcomings, the present invention provides a high frequency socket connector to mitigate or obviate the aforementioned problems.

SUMMARY OF THE INVENTION

The main objective of the invention is to provide a SMT type high frequency socket connector that has SMT type terminals soldered on a PCB through SMT soldering processes to reduce total size of the socket connector and raise the utilization rate of the PCB.

A high frequency socket connector in accordance with the present invention comprises an insulating housing, a mounting bracket, multiple first terminals, multiple second terminals and a shell. The first and second terminals are mounted in the insulating housing, are capable of implementing USB 3.0 protocol. The shell covers the insulating housing and terminals. Each of the terminals has a SMT soldering section adapted to SMT soldering processes. All the SMT soldering sections are arranged in a transverse row to make the socket connector compact.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
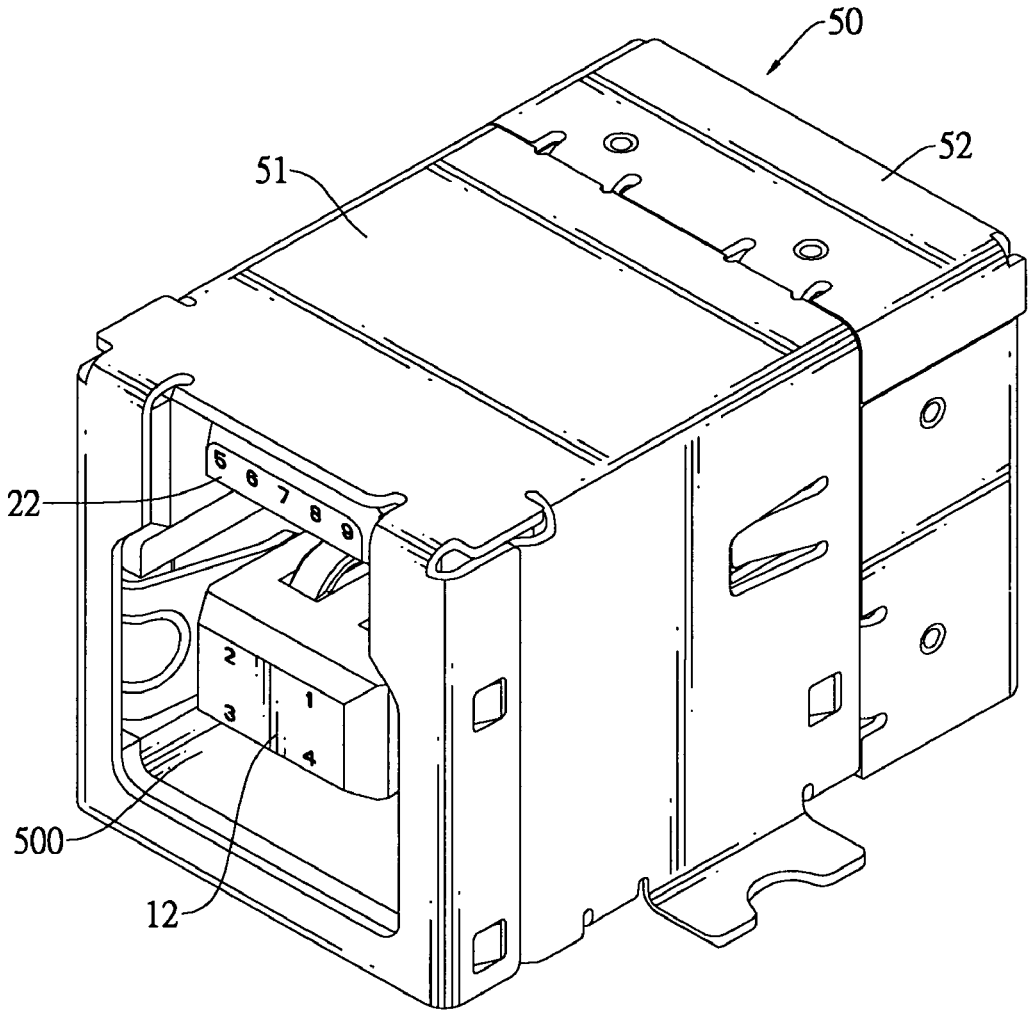
FIG. 1 is a perspective view of a high frequency socket connector in accordance with the present invention.
Figure 2:
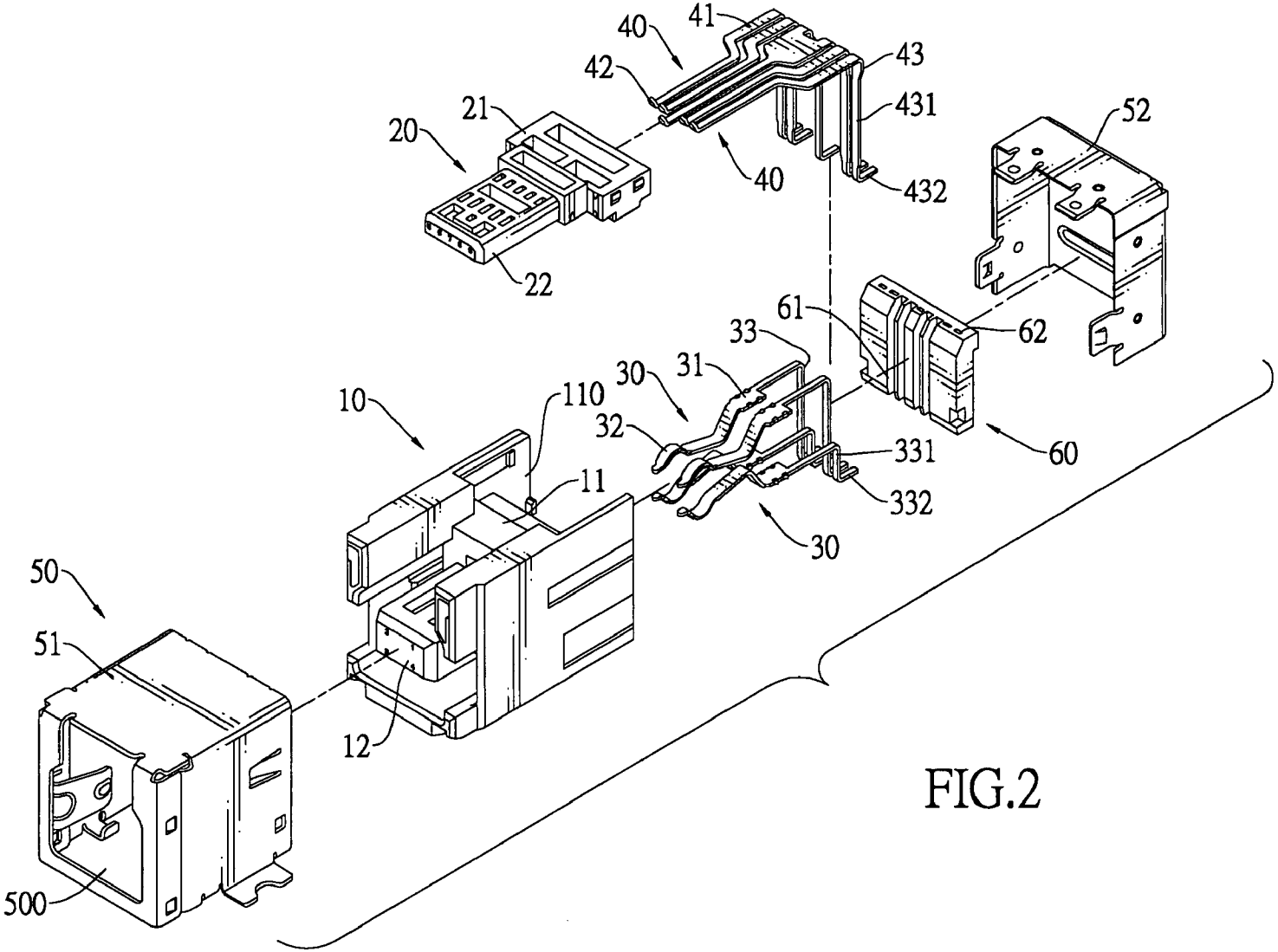
FIG. 2 is a front exploded perspective view of the high frequency socket connector in FIG. 1.
Figure 3:
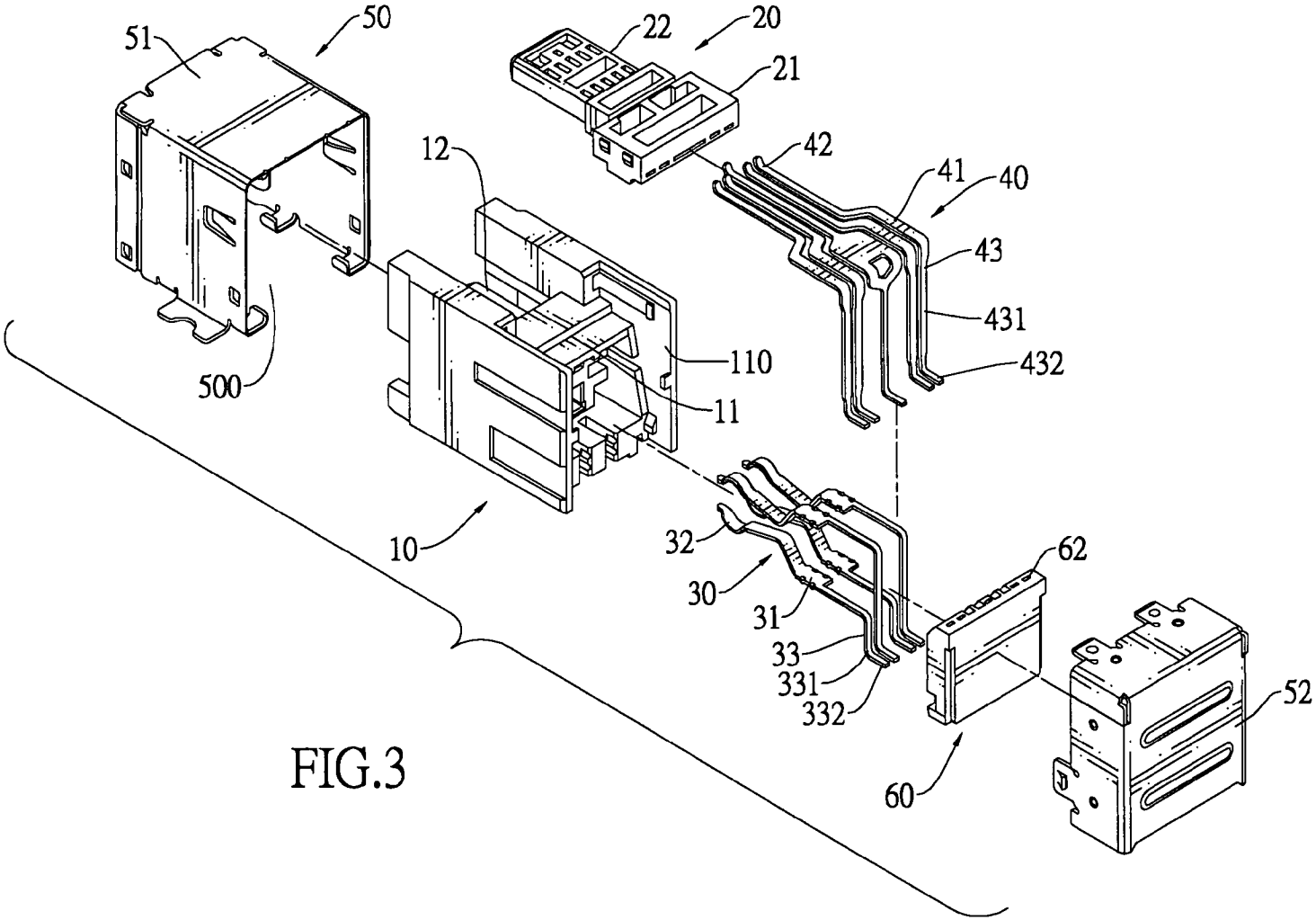
FIG. 3 is a rear exploded perspective view of the high frequency socket connector in FIG. 1.
Figure 4:
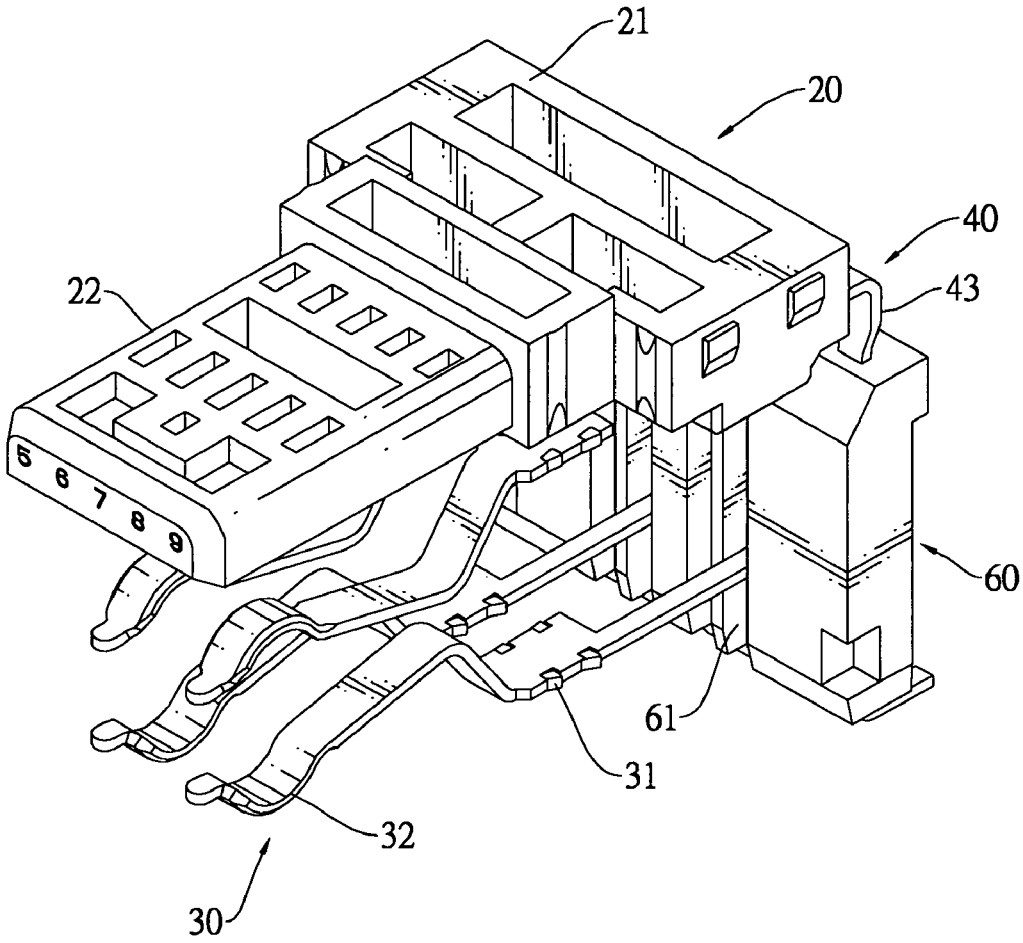
FIG. 4 is a front perspective view of the high frequency socket connector in FIG. 1 omitting the shell.

With reference to FIGS. 1 to 4 and 7, a SMT type high frequency socket connector in accordance with the present invention may be mounted on a PCB (90), may comply with the B type USB 3.0 socket connector standard and comprises a insulating housing (10), a mounting bracket (20), multiple first terminals (30), multiple second terminals (40), a shell (50) and a rear stopper (60).

The insulating housing (10) has a base (11) and a first tongue (12). The base (11) has a front and a rear and may further have a mounting recess (110) defined in the rear. The first tongue (12) is formed on and protrudes forwards from the front of the base (11).

Figure 5:
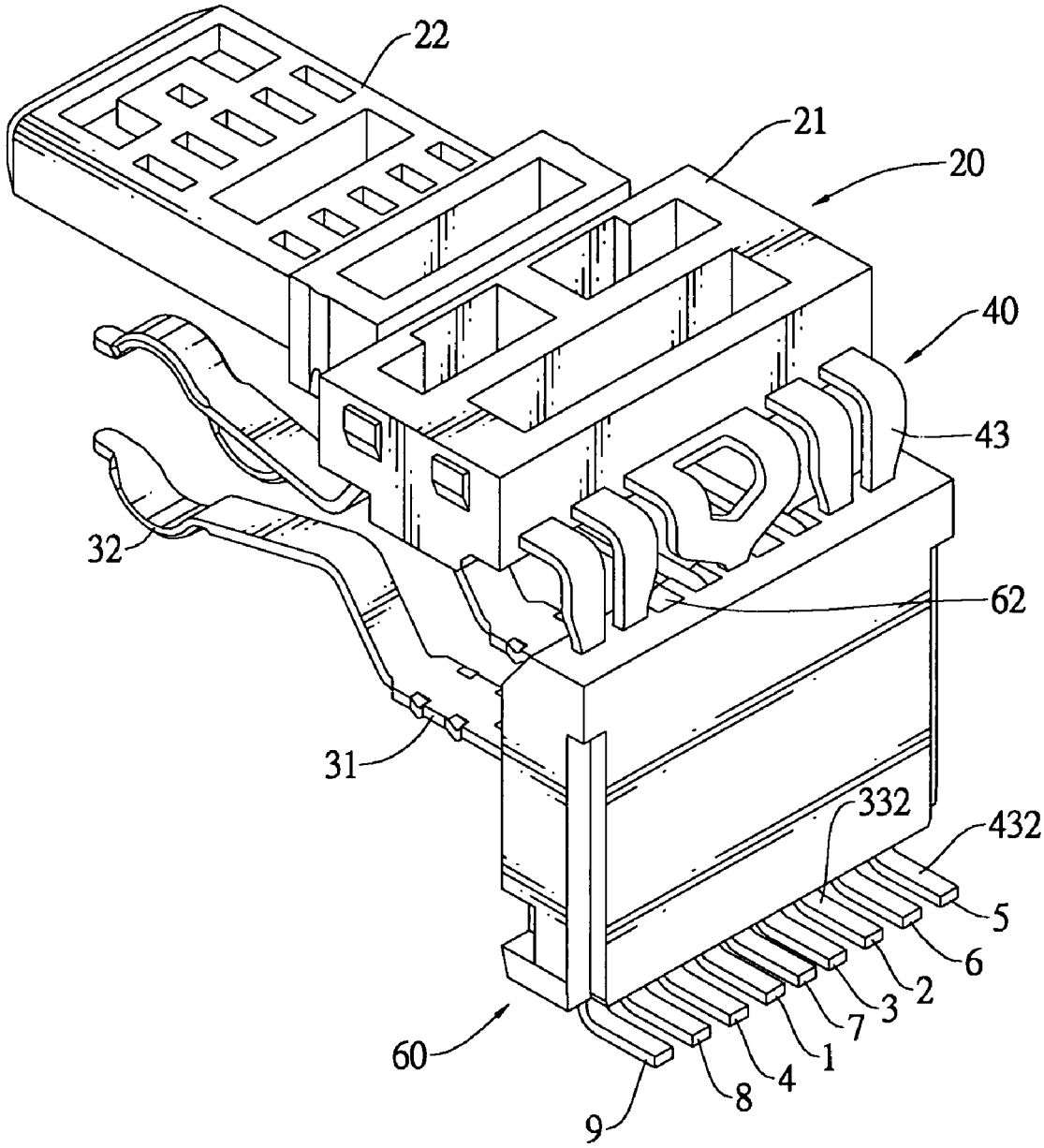
FIG. 5 is a rear perspective view of the high frequency socket connector in FIG. 1 omitting the shell.
Figure 9:
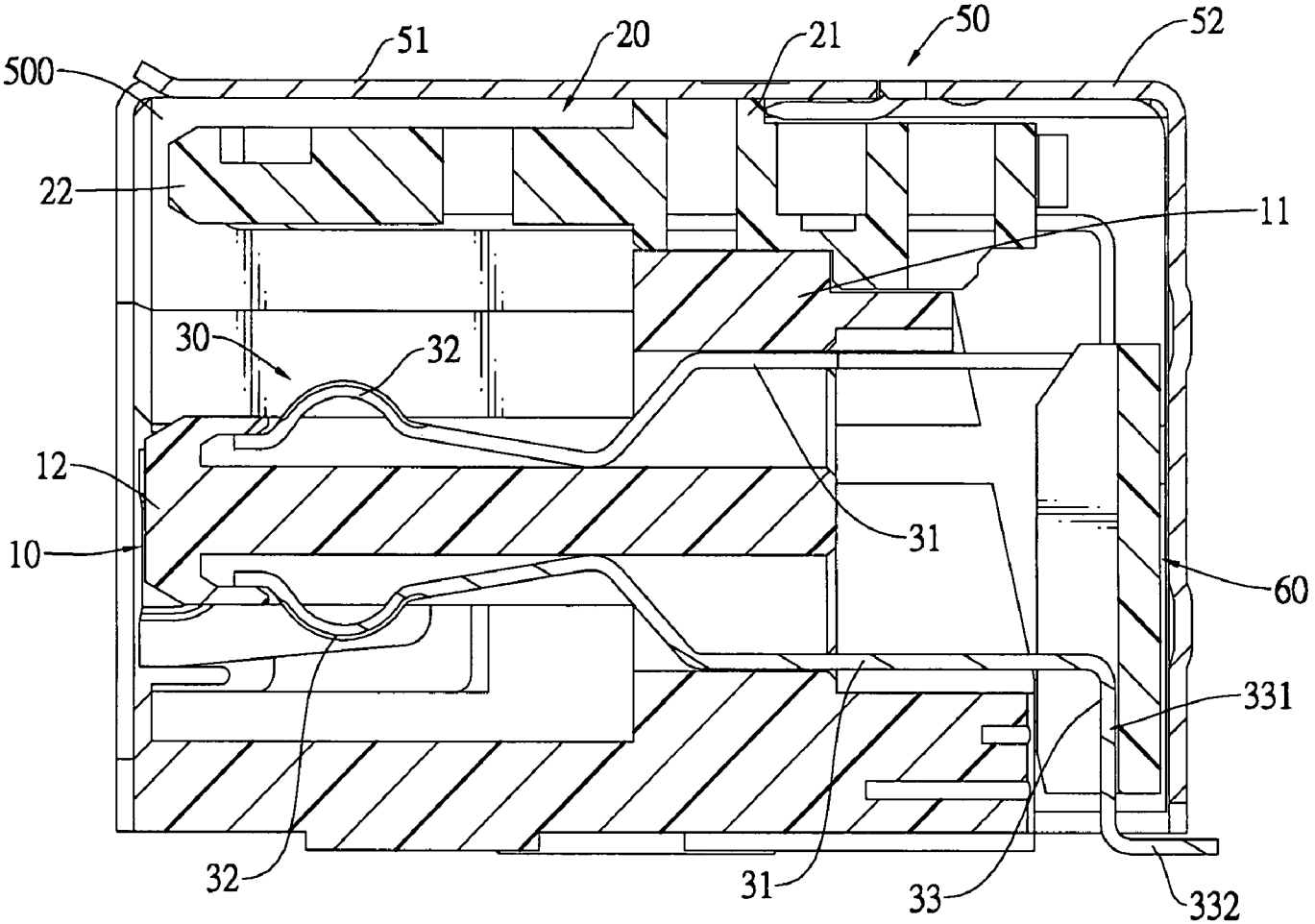
FIG. 9 is a cross sectional side view of the high frequency socket connector in FIG. 1.

With further reference to FIGS. 5 and 9, the mounting bracket (20) is mounted on the insulating housing (10) and has a seat (21) and a second tongue (22). The second tongue (22) is formed on and protrudes forward from the seat (21) and is located above the first tongue (12).

Figure 6:
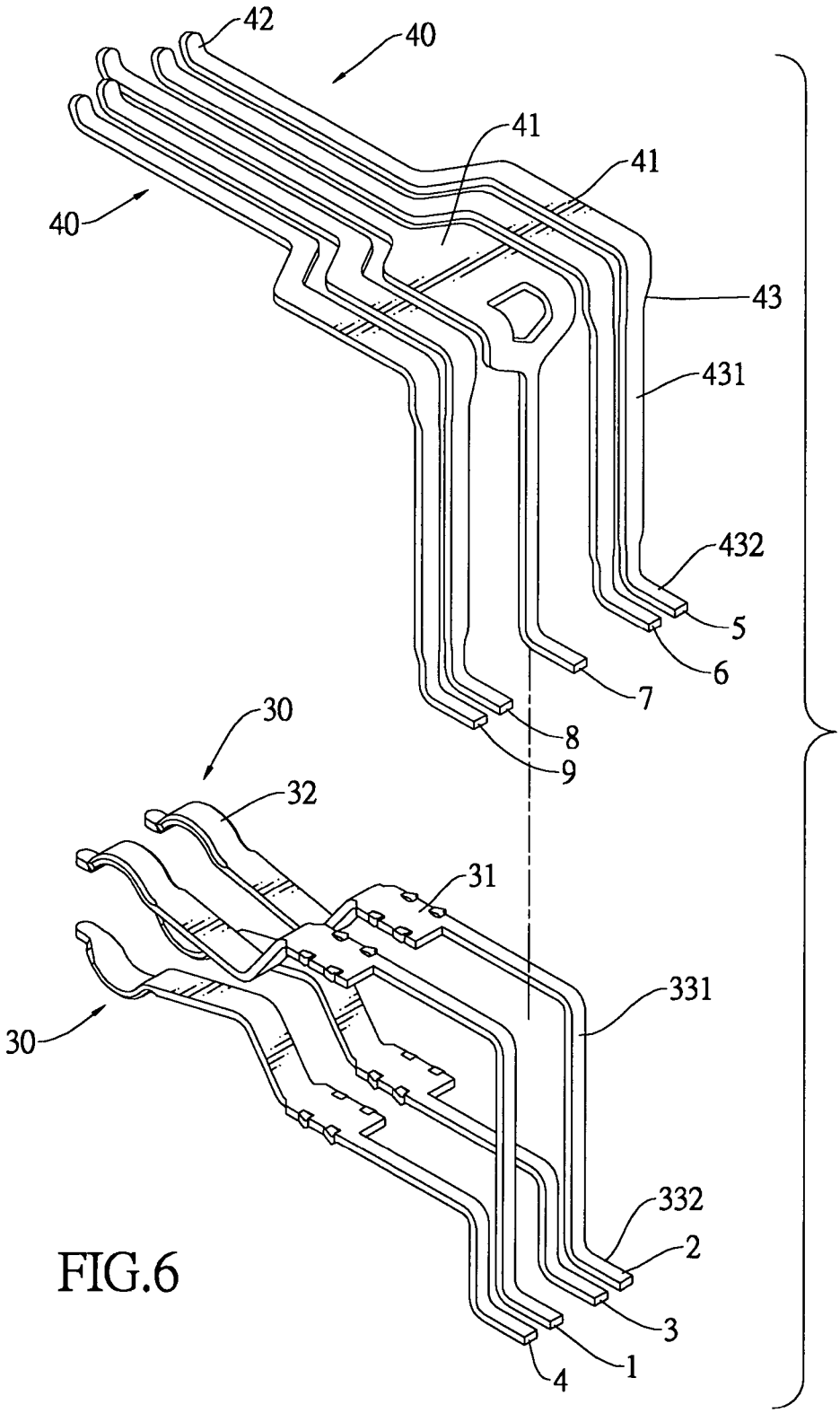
FIG. 6 is a rear exploded perspective view of the first and second terminals of the high frequency socket connector in FIG. 5.
Figure 10:
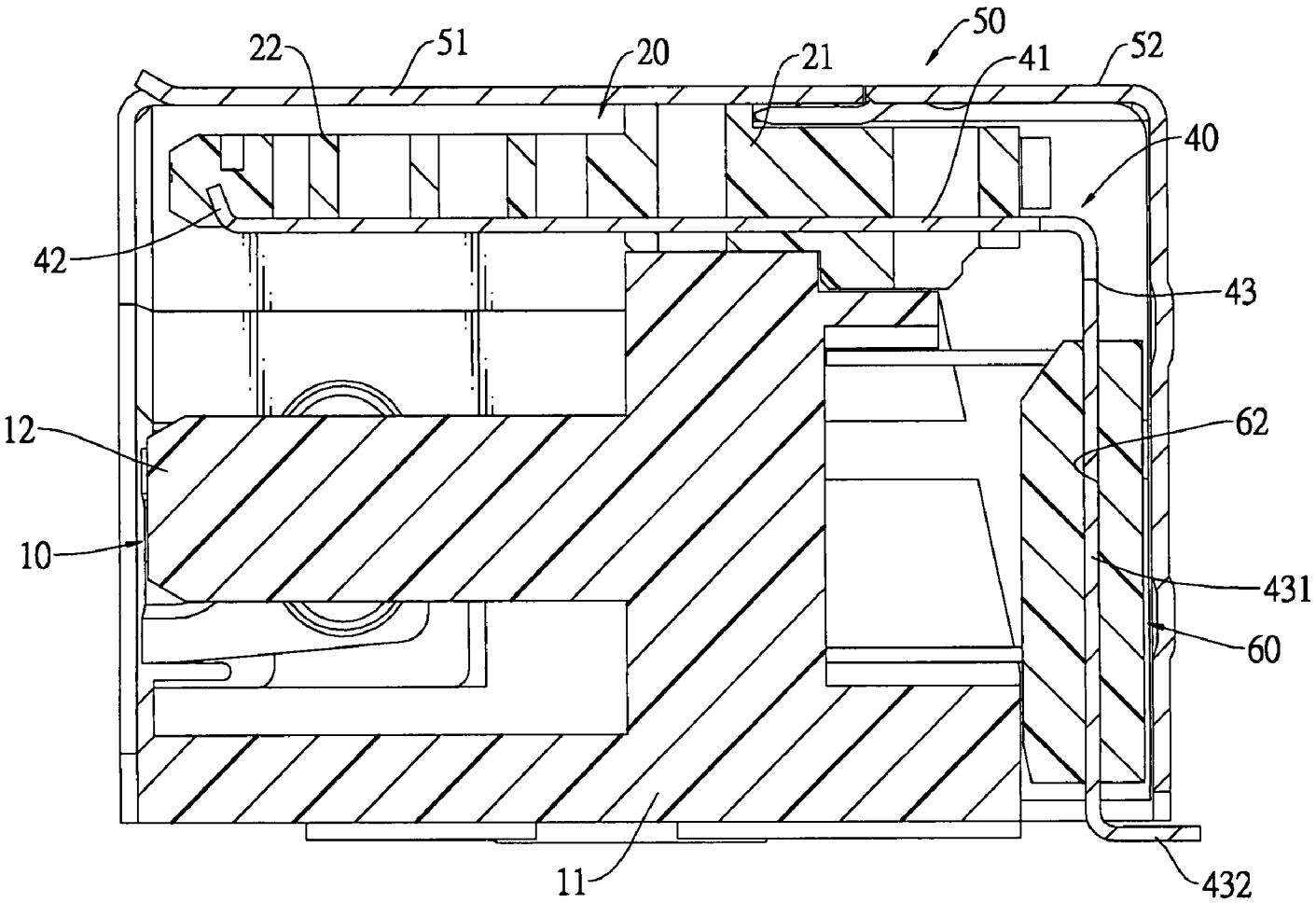
FIG. 10 is another cross sectional side view of the high frequency socket connector in FIG. 1.

With further reference to FIGS. 6 and 10, the first terminals (30) are mounted in the insulating housing (10), are capable of implementing USB 2.0 protocol and each first terminal (30) has a first mounting section (31), a second contacting section (32), and a first surface mount technology (SMT) soldering section (33).

The first mounting section (31) is mounted in the base (10) of the insulating housing (10).

The first contacting section (32) is formed on and protrudes forward from the first mounting section (31) and is mounted on the first tongue (12). The first contacting sections (32 ) may be classified into two sets respectively mounted on top and bottom surfaces of the first tongue (12).

The first SMT soldering section (33) is L-shaped, is formed on and protrudes downward from the first mounting section (31) and has a first vertical extension tab (331) and a first level soldering tab (332). The first vertical extension tab (331) is formed on and protrudes substantially perpendicularly down from the first mounting section (31). The first level soldering tab (332) is formed on and protrudes perpendicularly backward from the first vertical extension tab (331) and is soldered on the PCB (90).

The second terminals (40) are mounted in the mounting bracket (20), are capable of cooperating with the first terminals (30) to implement USB 3.0 protocol and each second terminal (40) has a second mounting section (41), a second contacting section (42) and a second surface mount technology (SMT) soldering section (43).

The second mounting section (41) is mounted in the seat (21) of the mounting bracket (20).

The second contacting section (42) is formed on and protrudes forward from the second mounting section (41) and is mounted on the second tongue (22) of the mounting bracket (20).

The second SMT soldering section (43) is L-shaped, is formed on and protrudes downward from the section mounting section (41) and has a second vertical extension tab (431) and a second level soldering tab (432). The second vertical extension tab (431) is formed on and protrudes substantially perpendicularly down from the second mounting section (41). The second level soldering tab (432) is formed on and protrudes perpendicularly backward from the second vertical extension tab (431) and is soldered on the PCB (90).

Furthermore, the first and second SMT soldering sections (33, 43) of the firs and second terminals (30, 40) are arranged in a single transverse row. The second terminals (40) may have two pairs of signal transmission terminals. The pairs of the second level soldering tabs of the signal transmission terminals are separated by one first or second level soldering tab (332, 432) of one first or second terminal (30, 40) to prevent the crosstalk.

The shell (50) is made of metal, covers the insulating housing (10), the mounting bracket (20), the first terminals (30) and the second terminals (40). Furthermore, the shell (50) may be assembled by a front casing (51) and a rear casing (52). The front casing has a cavity (500). The cavity is defined through the front casing, accommodates the insulating housing (10), the mounting bracket (20), the first terminals (30) and the second terminals (40) and has a front opening serving as a socket hole.

The rear stopper (60) is mounted in the mounting recess (110) and covers the first and second vertical extension tabs (331, 431) of the first and second SMT soldering sections (33, 43) of the first and second terminals (30, 40). The rear stopper (60) may have multiple positioning slots (61) and multiple positioning holes (62). The positioning slots (61) are defined in the rear stopper (60) and respectively hold the first vertical extension tabs (331) of the first terminals (30). The positioning holes (62) are defined through the rear stopper (60) and respectively hold the second vertical extension tabs (431) of the second terminals (40).

Furthermore, the first terminals (30) are numbered as No. 4 to No. 1 terminals (4, 3, 2, 1) that are defined respectively as a power grounding terminal (without signal transmission purposes), a positive signal terminal (the aforementioned signal transmission terminal), a negative signal terminal (i.e. the aforementioned signal transmission terminal) and a power terminal (without signal transmission purposes).

Figure 7:
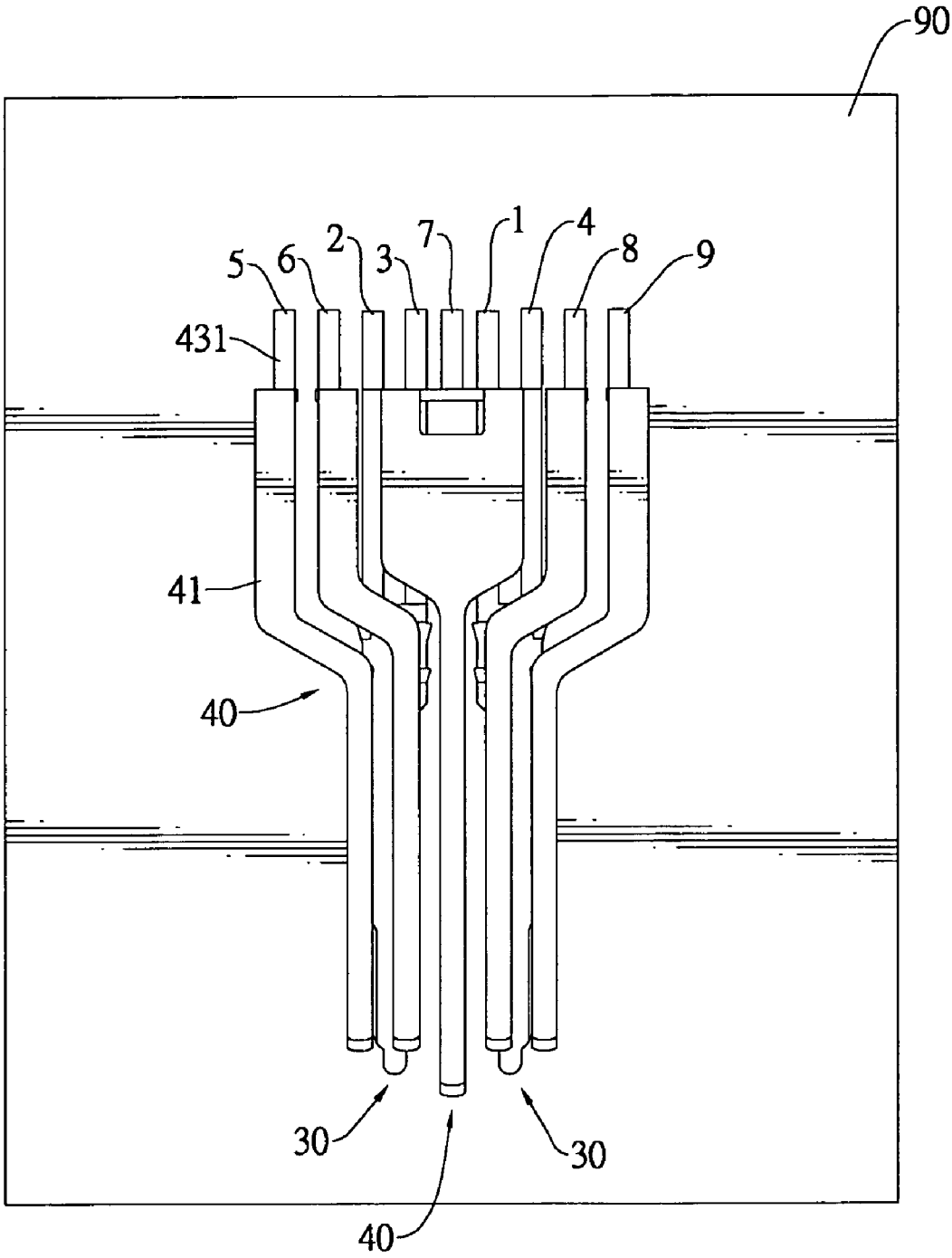
FIG. 7 is a top view of the first and second terminals of the high frequency socket connector in FIG. 6 with a printed circuit board.

In a preferred embodiment, the second terminals are numbered as fifth to ninth terminals (5, 6, 7, 8, 9) and are defined respectively as a negative super-speed receiver terminal, (i.e. the aforementioned signal transmission terminal), a positive super-speed receiver terminal (i.e. the aforementioned signal transmission terminal), a signal grounding terminal (without signal transmission purposes), a negative super-speed transmitter terminal (i.e. the aforementioned signal transmission terminal) and a positive super-speed transmitter terminal (i.e. the aforementioned signal transmission terminal). The first and second SMT soldering sections (33, 43) of the first and second terminals (30, 40) are arranged in a row according the sequence of No. 5, 6, 2, 3, 7, 1, 4, 8, 9 terminals (5, 6, 2, 3, 7, 1, 4, 8, 9), as shown in FIG. 7.

The following Table A is according to section 5.3.1.2 "Pin Assignment and Description" of the "Universal Serial Bus 3.0 Specification Revision 1.0" settled and published by the USB IF.

TABLE A

Terminal Assignment

| Terminal Number | Name | Assignment | Description |
|---|---|---|---|
| No. 5 terminal (5) | StdA_SSRx− | Negative Super-speed receiver terminal | Super-speed receiver differential pair |
| No. 6 terminal (6) | StdA_SSRx+ | Positive super-speed receiver terminal | |
| No. 2 terminal (2) | D− | Negative signal terminal | USB2.0 differential pair |
| No. 3 terminal (3) | D+ | Positive signal terminal | |
| No. 1 terminal (1) | VBUS | Power terminal | |
| No. 4 terminal (4) | GND | Power-return-grounding terminal | |
| No. 7 terminal (7) | GND_DRAIN | Signal return-grounding terminal | |
| No. 8 terminal (8) | StdA_SSTx− | Negative super-speed transmitter terminal | Super-speed transmitter differential pair |
| No. 9 terminal (9) | StdA_Tx+ | Positive super-speed transmitter terminal | |

As shown in Table A, the pairs of the signal transmission terminals such as the pair of the No. 5 and 6 terminals (5, 6) and the pair of the No. 8 and 9 (8, 9) are separated by the No 4 and 7 terminals (4, 7) that are grounding terminals. Such separation prevents crosstalk between the pairs of the signal transmission terminals.

Figure 8:
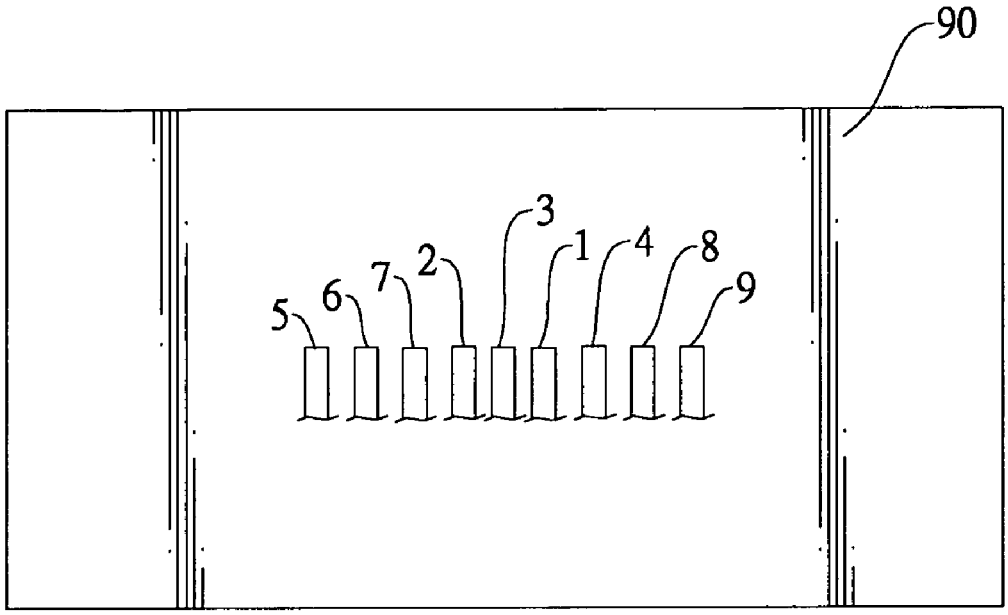
FIG. 8 is a top view of the soldering sections of the first and second terminals of a different embodiment of the high frequency socket connector in accordance with the present invention.

In another preferred embodiment, the first and second SMT soldering sections (33, 43) of the first and second terminals (30, 40) are arranged in a row according the sequence of No. 5, 6, 7, 2, 3, 1, 4, 8, 9 terminals (5, 6, 7, 2, 3, 1, 4, 8, 9), as shown in FIG. 8. The pairs of the signal transmission terminals such as the pair of the No. 5 and 6 terminals (5, 6) and the pair of the No. 8 and 9 (8, 9) are separated by the No. 4 and 7 terminals (4, 7) that are grounding terminals. Such separation prevents crosstalk between the pairs of the signal transmission terminals.

The first and second terminals (30, 40) are mounted respectively on the first and second tongues (12, 22) to comply with the B type socket connector standard and implement the USB 3.0 protocol. Furthermore, the first and second SMT soldering sections (33, 43) allow the SMT soldering process to make the high frequency socket connector more compact than conventional connectors. the pairs of the signal transmission terminals of the second terminals (40) are separated to effectively prevent crosstalk.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A high frequency socket connector comprising:

an insulating housing having a mounting recess;

a base positioned in the mounting recess having a front and a rear; and a first tongue formed on and protruding forward from the rear of the base;

a mounting bracket member with mounting bracket elements on sides of the mounting bracket member and being mounted in the mounting recess of the insulating housing and having a seat; and a second tongue formed on and protruding forward from the seat and located above the first tongue;

multiple first terminals mounted in the insulating housing, capable of implementing USB 2.0 protocol and each first terminal having a first SMT soldering section being L-shaped, each first SMT soldering section having a first vertical extension tab and a first level soldering tab formed on and protruding perpendicularly form backward from the first vertical extension tab;

multiple second terminals mounted in the insulating housing, capable of cooperating with the first terminals to implementing USB 3.0 protocol and each second terminal having a second SMT soldering section being L-shaped, each second SMT soldering section having a second vertical extension tab and a second level soldering tab formed on and protruding perpendicularly form backward from the second vertical extension tab; and a shell covering the insulating housing, the mounting bracket member and the first terminals and the second terminals;

a rear stopper is mounted in the mounting recess and covers the first and second vertical extension tabs of the first and second SMT soldering sections of the first and second terminals; and wherein the rear stopper has multiple positioning slots defined along a surface of the rear stopper and respectively holding the first vertical extension tabs of the first terminals; and multiple positioning holes defined through the rear stopper and respectively holding the second vertical extension tabs of the second terminals.

2. The high frequency socket connector as claimed in claim 1, wherein the first terminals are capable of implementing USB 2.0 protocol.

3. The high frequency socket connector as claimed in claim 1, wherein the first and second SMT soldering sections of the first and second terminals are arranged in a single transverse row.

4. The high frequency socket connector as claimed in claim 3, wherein the first terminals are capable of implementing USB 2.0 protocol.

5. The high frequency socket connector as claimed in claim 3, wherein the second terminals have two pairs of signal transmission terminals; and the pairs of the second level soldering tabs of the signal transmission terminals are separated by one first or second level soldering tab of one first or second terminal to prevent the crosstalk.

6. The high frequency socket connector as claimed in claim 5, wherein the high frequency socket connector complies with a B type USB 3.0 socket connector standard.

7. The high frequency socket connector as claimed in claim 6, wherein each first terminal further has a first mounting section and a first contacting section, the first mounting section is mounted in the base of the insulating housing, the first contacting section is formed on and protrudes forward from the first mounting section and is mounted on the first tongue, and the first SMT soldering section of the first terminal is formed on and protrudes downward from the first mounting section.

8. The high frequency socket connector as claimed in claim 7, wherein each second terminal further has a second mounting section and a second contacting section, the second mounting section is mounted in the seat of the mounting bracket, the second contacting section is formed on and protrudes forward from the second mounting section and is mounted on the second tongue, and the second SMT soldering section of the second terminal is formed on and protrudes downward from the second mounting section.

9. The high frequency socket connector as claimed in claim 8, wherein the shell is assembled by a front casing and a rear casing, and the front casing has a cavity defined through the front casing, accommodating the insulating housing, the mounting bracket, the first terminals and the second terminals and having a front opening serving as a socket hole.

10. The high frequency socket connector as claimed in claim 5, wherein the first terminals are capable of implementing USB 2.0 protocol.

* * * * *